US010767653B2

(12) United States Patent
Holbrook et al.

(10) Patent No.: US 10,767,653 B2
(45) Date of Patent: Sep. 8, 2020

(54) VACUUM PUMP

(71) Applicant: Edwards Limited, Burgess Hill, West Sussex (GB)

(72) Inventors: Alan Ernest Kinnaird Holbrook, Crawley (GB); Paul Milner, Crawley (GB)

(73) Assignee: Edwards Limited, Burgess Hill, West Sussex (GB)

( * ) Notice: Subject to any disclaimer, the term of this patent is extended or adjusted under 35 U.S.C. 154(b) by 274 days.

(21) Appl. No.: 16/060,191

(22) PCT Filed: Dec. 13, 2016

(86) PCT No.: PCT/GB2016/053926
§ 371 (c)(1),
(2) Date: Jun. 7, 2018

(87) PCT Pub. No.: WO2017/103580
PCT Pub. Date: Jun. 22, 2017

(65) Prior Publication Data

US 2018/0363663 A1 Dec. 20, 2018

(30) Foreign Application Priority Data

Dec. 14, 2015 (GB) ..... 1521981.9

(51) Int. Cl.
*F04D 19/04* (2006.01)
*F04D 29/056* (2006.01)
(Continued)

(52) U.S. Cl.
CPC ..... *F04D 19/042* (2013.01); *F04D 29/056* (2013.01); *F04D 29/0563* (2013.01);
(Continued)

(58) Field of Classification Search
CPC ..... F04D 19/042; F04D 19/04; F04D 19/046; F04D 19/048; F04D 19/044;
(Continued)

(56) References Cited

U.S. PATENT DOCUMENTS 4,082,376 A 4/1978 Wehde et al.
2002/0054815 A1* 5/2002 Kawasaki ..... F04D 19/046 415/90

(Continued)

FOREIGN PATENT DOCUMENTS

DE 3708663 A1 10/1987
DE 202013009660 U1 2/2015

(Continued)

OTHER PUBLICATIONS

British Search Report dated Jun. 13, 2016 and Examination Report dated Jun. 14, 2016 for corresponding British Application No. GB1521981.9.

(Continued)

*Primary Examiner* — Bryan R Perez
(74) *Attorney, Agent, or Firm* — Theodore M. Magee; Westman, Champlin & Koehler, P.A.

(57) ABSTRACT

The present invention relates to a turbo-molecular vacuum pump comprising bearings for supporting the drive shaft and/or the rotor in relation to a pump body, wherein a first bearing is coupled to the rotor and disposed on supporting mount at the high vacuum side of the rotor and radial struts extend from the supporting mount and form an integral part of the body; the invention is characterised in that the radial struts comprise a hinge portion that can flex to allow relative movement of the inlet flange with respect to the supporting mount to reduce distortion effects.

16 Claims, 2 Drawing Sheets

(51) Int. Cl.
*F04D 29/60* (2006.01)
*F04D 29/66* (2006.01)

(52) U.S. Cl.
CPC ..... *F04D 29/601* (2013.01); *F04D 29/668* (2013.01); *F04D 19/048* (2013.01)

(58) Field of Classification Search
CPC .. F04D 29/601; F04D 29/5853; F04D 17/168; F04C 25/02; F04C 18/16; F04C 23/001
See application file for complete search history.

(56) References Cited

U.S. PATENT DOCUMENTS

| | | | |
|---|---|---|---|
| 2003/0170132 | A1 | 9/2003 | Englander et al. |
| 2008/0309184 | A1 | 12/2008 | Eilers et al. |

FOREIGN PATENT DOCUMENTS

| | | | |
|---|---|---|---|
| DE | 102014103060 | A1 | 9/2015 |
| EP | 3051139 | A1 | 8/2016 |

OTHER PUBLICATIONS

PCT Search Report and Written Opinion dated Feb. 28, 2017 for corresponding PCT Application No. PCT/GB2016/053926.

* cited by examiner

VACUUM PUMP

CROSS-REFERENCE OF RELATED APPLICATION

This application is a Section 371 National Stage Application of International Application No. PCT/GB2016/053926, filed Dec. 13, 2016, which is incorporated by reference in its entirety and published as WO 2017/103580 A1 on Jun. 22, 2017 and which claims priority of British Application No. 1521981.9, filed Dec. 14, 2015.

FIELD

Embodiments relate to a vacuum pump and a bearing support that is used in a vacuum pump. In particular, but not exclusively, the embodiments are utilized in turbo-molecular vacuum pumps comprising bearings for supporting the pump's rotor having a first bearing located on a high pressure side of the rotor and a second bearing located in the vacuum side of the rotor.

BACKGROUND

Turbo-molecular vacuum pumps are well known to the person skilled in the art. Such pumps comprise a mechanism suited to pump gases at high vacuum pressures, including rotor and stator components each having blades extending radially from an axis. At high vacuum pressures the gas molecules behave in a molecular flow regime.

It can be advantageous to locate rotor bearings at each end of the rotor shaft, depending on the application that the pump is designed to serve. Thus, the rotor can be supported in a way that minimizes rotor movement during operational conditions. As a result, the bearing located on the rotor shaft nearest to the pump inlet is located in an area of high vacuum pressure.

In certain circumstances it may been necessary to use non-contacting bearings in this location in order to minimize contamination that might be caused by bearing lubricant. Such non-contacting bearings include magnetic bearings that can configured as passive magnetic bearings or active magnetic bearings. In all cases, the bearings located at the pump inlet side of the rotor are located on the rotor's axis and coupled to the pump body by a series of spokes extending from a central bearing support hub. Thus, the bearing is secured in the desired position coaxially with the axis of the rotor and/or drive shaft. The spoke and hub arrangement can be called a "bearing spider"; this arrangement for supporting the bearing resembles a spoked steering wheel used in automotive vehicles, typically having an outer circular rim and a central boss connected to the rim by three or more equally spaced spokes.

A typical turbo-molecular pump bearing system is disclosed in DE202013009660U1 where the bearing spider is a separate component that is inserted into the pump. An outer rim of the bearing spider is arranged to engage with the pump body to secure a passive magnetic bearing in the correct central location. A similar arrangement is disclosed in US2003/0170132. In both these documents, the bearing spider is shown as a separate component that is located in position during pump assembly.

It is also known to provide the bearing spider as a component that is integral with the pump body. Such arrangements are known from pumps sold by Pfeiffer Vacuum GmbH, such as the Hipace 80 and Hipace 300 pumps. Additionally the EXT555 vacuum pump sold by Edwards Limited has a similar arrangement. In this integral configuration the spokes of the bearing spider extend in a generally radial direction from the inner section of the pump's inlet flange towards the central hub. The pump body and bearing spider can be machined from the same block of material, thereby reducing the number of component parts. Furthermore, this integral configuration for the bearing spider has other advantages in that the number of assembly steps can be reduced, tolerance stack-up can be reduced, the length of the pump can be reduced and controls on the bearing assembly process can be improved.

There is a general desire to improve the performance of turbo-molecular pumps that have a bearing spider on the high vacuum side of the rotor where the bearing spider is an integral part of the pump body. Furthermore, there is a desire to reduce the size and power consumption of such vacuum pumps without reducing the performance parameters of the pump.

The discussion above is merely provided for general background information and is not intended to be used as an aid in determining the scope of the claimed subject matter. The claimed subject matter is not limited to implementations that solve any or all disadvantages noted in the background.

SUMMARY

In order to try and achieve these desires, there is provided a turbo-molecular vacuum pump comprising: a body having an inlet flange disposed at a high vacuum side for connecting the turbo-molecular vacuum pump with a chamber to be evacuated, and an outlet port disposed at a low vacuum side for exhausting pumped gases from the turbo-molecular vacuum pump; disposed within the body there is a stator and a rotor arranged to move relative to the stator such that, during use, gas molecules are urged from the inlet flange towards the outlet port, the rotor is coupled to a motor by a drive shaft for driving the rotor in a rotary motion; and bearings for supporting the drive shaft and/or the rotor in relation to the body, wherein a first bearing is coupled to the rotor and disposed on supporting mount at the high vacuum side of the rotor, radial struts extend from the supporting mount and form an integral part of the body; characterized in that the radial struts comprise a hinge portion that can flex to allow relative movement of the inlet flange with respect to the supporting mount. In addition, the embodiments provide a body for a turbo-molecular vacuum pump comprising the features described above.

The first bearing can be a passive magnetic bearing and the radial struts can form an integral part of the inlet flange. In addition, the hinge portion can comprise a notch or pinched point in the strut. Thus, the hinged portion (that is, the notch/pinched point) provides an area designed to flex and decouple any movement in the inlet flange from the hinged portion. The axial depth of the strut at the notch should be sufficient to prevent axial movement of the supporting mount relative to the body during normal operation of the turbo-molecular vacuum pump. Also, the axial depth of the strut at the notch should be sufficient to allow inlet flange distortions that can occur (when a flange clamping force is applied) to be decoupled from the supporting mount, thus allowing the supporting mount to move relative to the body or inlet flange. Furthermore, the axial depth of the notch can be between 80% and 10% of the maximum axial depth of the strut, or wherein the axial depth of the notch can be between 50% and 20% of the maximum axial depth of the strut, or the axial depth of the notch can be 33% of the maximum axial depth of the strut.

The notch can be formed in the strut at a position where the strut meets the body. This arrangement can maximize the effect of the location of the hinged portion so as to maximize the decoupling effect of the hinge support. Thus, where the radial struts join the pump body at a location close to the inlet flange, the hinge portion of the radial strut is arranged to decouple the bearing support from force that can be applied to the inlet flange. As a result, when the inlet is secured to a chamber or vacuum conduit using a clamping force, torsional movement of the inlet flange is decoupled from the bearing support via the hinge portion or notch.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present application are now described by way of example with reference to the following drawings, of which.

DETAILED DESCRIPTION

Greater control of tolerance stack up is required as a result to maintain clearances between the rotor and stator during pump operation. Therefore, the accurate position of bearings on the drive shaft or rotor becomes more critical. A bearing spider can be used to locate the bearing with a high degree of accuracy when a bearing is provided on the vacuum side of the rotor. It has been understood that a relatively high level of accurate positioning can be achieved by integrating the bearing spider with the pump body such that the bearing spider and pump body are formed from a single piece of material.

Commercial considerations are increasing the push to reduce pump size, which has resulted (in some circumstances, depending on the pump's application) in the rotor being placed as near to the pump inlet as practically possible. As a result, the point at which a bearing spider joins the pump body can be coincidental with an inlet flange. The flange can be formed integrally with the pump body typically comprises a standard arrangement that cooperates with standard clamping tools. A high vacuum seal is often used between the pump flange and another surface that engages the flange face.

Application of a clamping force to the inlet flange can cause the inlet flange to distort by relatively very small amounts. These distortions are typically insufficient to compromise the vacuum seal that is formed at the flange. As such, until now, the distortion of the inlet flange has been acceptable and of no undue concern.

However, we have noticed that these distortions now have an effect on the bearing spider. This undesirable effect is especially noticeable when the bearing spider and pump body are integral with one another and joined at the inlet flange. The torsional moment applied to the flange by the clamp is transmitted to the bearing spider causing the central portion of the bearing spider to become displaced by an undesirable amount. This in turn causes the bearing itself to become displaced such that accurate placement of the rotor is no longer achievable to the now desired amount. As a result, pump failure may occur if the rotor is not located accurately because the rotor and stator clash during operation. The problem is compounded if the bearing spider comprises magnetic bearings that have bearing components which do not make physical contact with one another, but rather rely on magnetic forces of attraction and repulsion.

Figure 1:
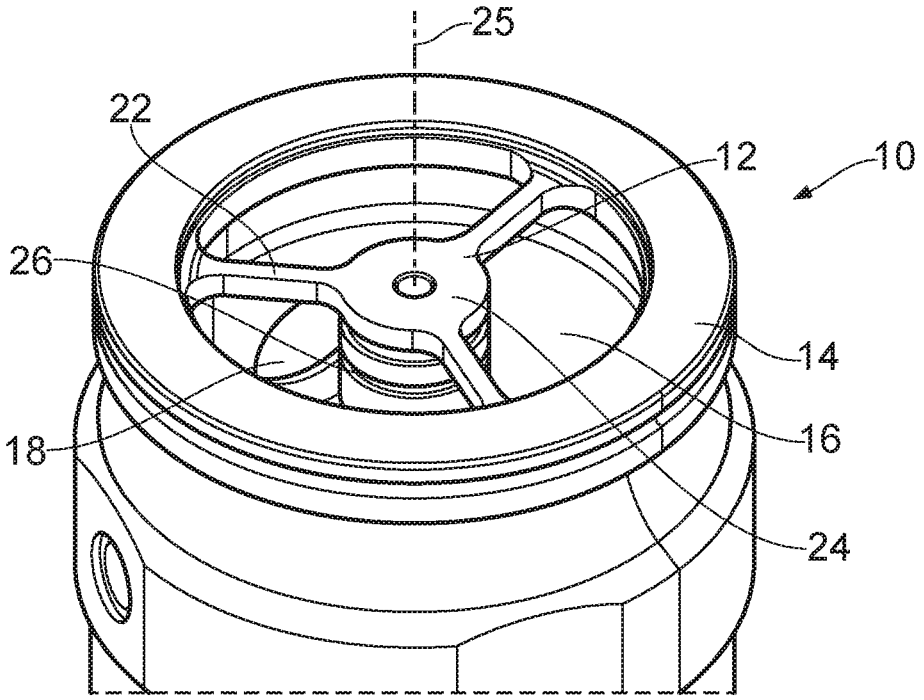
FIG. 1 is a schematic drawing of a portion of a pump.
Figure 2:
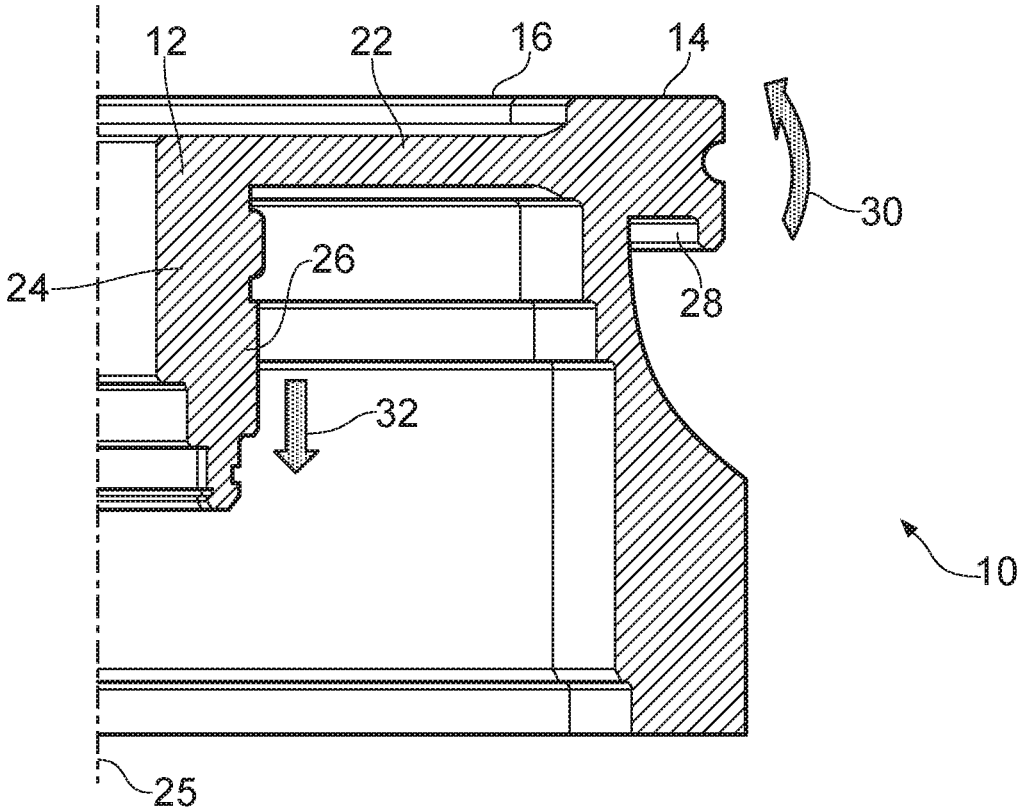
FIG. 2 is a cross section of the portion of the pump shown in FIG. 1.

FIGS. 1 and 2 show a pump body 10 having a bearing spider 12 on the vacuum side of a rotor (not shown for clarity). An inlet flange 14 forms the inlet 16 of the pump. The outlet 18 is located at the bottom end of the pump body 10. The pump body forms a housing in which the pump components, including a rotor, stator, motor, drive shaft and other components are located.

The bearing spider 12 is integrally formed on the inside of the body 10 at a location co-located with the inlet flange, which is also integrally formed with the body. The bearing spider 12 comprises three spokes or struts 22 that extend radially out from a central hub 24 located coaxially with the axis of rotation 25. A portion of bearing system 26 is located on the hub to cooperate with another portion of the bearing that is located on the rotor (not shown). Thus, during pump operation, the bearing spider 22 is located in a region of high vacuum on the inlet side of the rotor. As a result it is typical to use passive magnetic bearings because they are best suited to operating in high vacuum pressure environments, in certain applications.

Referring to FIG. 2, a cross-section of the pump body is shown. The same numerical indicators have been used on the elements of the pump body described above. The bearing spider 12 and the inlet flange 14 are approximately in the same plane and the point at which the struts 22 meet the body 10 coincides with the inlet flange. The struts have an approximately constant thickness in the axial direction. Thus, the struts provide axial and radial positioning of the central hub 24 with sufficient support to hold the bearing in position during operational use.

The inlet flange 14 comprises an engagement portion 28 arranged to engage with and locate a mechanical clamp. The mechanical clamp is used to secure the flange in place with an opposing flange member of a vessel to which the pump is attached (not shown). A suitable sealing O ring is used to provide a gas tight seal that can seal the inlet of the pump (at high vacuum pressures of the order of $10^{-8}$ mbar) from atmospheric pressure outside the pump body. To achieve this, the clamps are tightened with a torque force of 6-10 Nm or more. This clamping force causes the inlet flange to deform and twist slightly, as indicated by arrow 30. As a result of this twisting moment applied to the inlet flange, the struts 22 are also displaced because the inlet flange, pump body and bearing spider struts are co-located and integrally formed with one another. Thus, the twisting moment is transmitted to the bearing spider and causes the spider to move towards the rotor, thereby displacing the bearing as indicated by arrow 32.

Passive magnetic bearings are sensitive to axial movement because the magnets on each side of the bearing (the stator bearing component and the rotor bearing components) have to be accurately located in relation to each other so that the correct force is applied to the bearing components. In the circumstances described above, a relatively small displacement of one bearing components caused by the clamping force applied to the inlet flange can result in problems with the bearing that may ultimately lead to pump failure.

For instance, our tests have shown that the central bearing spider hub of a pump as shown in FIG. 2, can become displaced by up to 25 μm when a 10 Nm clamping force is applied to the inlet flange by claw clamps. When using a rotatable flange collar applying a torque force of 10 Nm the bearing spider hub can become deflected by 200 μm.

Figure 3:
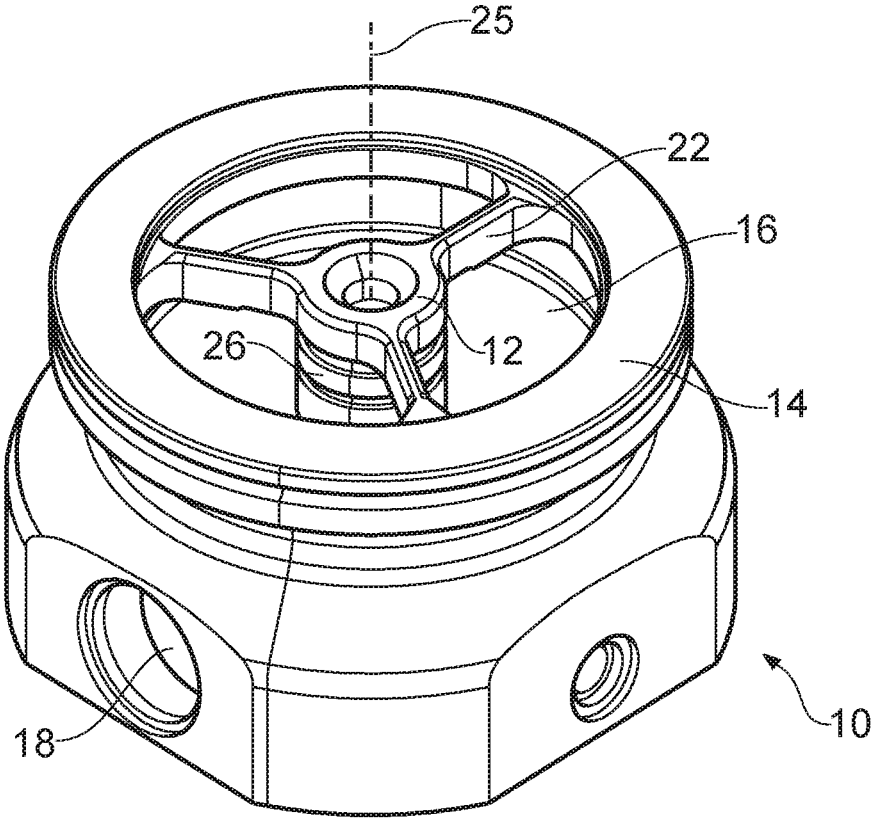
FIG. 3 is a schematic drawing of a portion of a pump in accordance with one embodiment.
Figure 4:
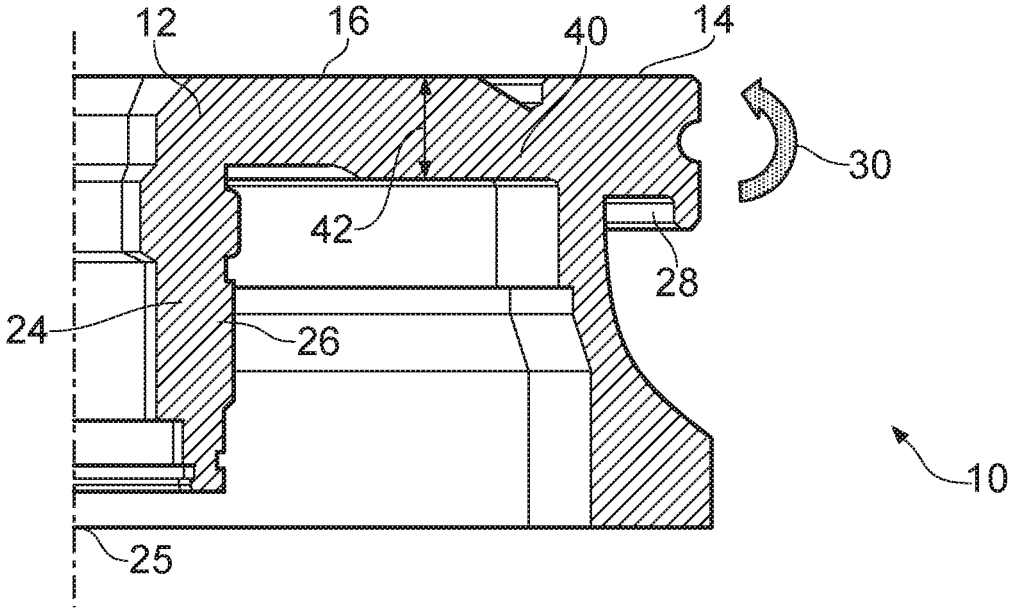
FIG. 4 is a cross section of the portion of the pump shown in FIG. 3.

An embodiment is shown in FIGS. 3 and 4. The same reference numerals are used to indicate features common with the pump described above. The embodiments aim to overcome the issues that we have found and described above. Referring to FIG. 3, a portion of a vacuum pump body according to the embodiments is shown. A cross-section of a portion of the same pump body shown in FIG. 3 is provided in FIG. 4. In general terms, the central bearing spider is provided in a location that is coaxial with the pump axis 25. The bearing spider has three struts or legs that extend radially from the central hub towards the inlet flange 14.

A pinched section or notch 40 is formed at the point where the struts are integrally formed with and meet the pump body. The pinched section has an axial thickness that is substantially reduced with respect to the maximum axial thickness of the strut, as indicated by arrow 42. Typically, a reduction in thickness of the order of between 10% and 80%, or more preferably between 20% and 50%. In the device shown in FIG. 4, the pinched section is 33% the maximum axial thickness, thus the axial thickness at the narrowest portion of the pinched section 40 is ⅔ the maximum axial thickness.

This arrangement provides a flex point in the strut that can hinge or bend when a force is applied to the strut. As a result, when a torsional clamping force (as indicated by arrow 30) is applied to the inlet flange clamp engagement portion 28, the resulting movement in the flange is significantly decoupled from the bearing spider 12. The pinched section provides a hinged portion of the strut. By providing the pinched point 40 close to the inlet flange, any rotational movement of the flange caused by the clamping force results in the struts bending, hinging or flexing at the pinched point. This flexing reduces axial movement in the bearing spider that may otherwise have occurred should the pinched point not be utilized.

The pinched point 40 should be strong enough to provide structural strength to the bearing spider support during the operational cycle of the pump. The thickness of the struts in an axial direction should be greater than the pinched point to provide additional rigidity and stiffness such that the flexing of the strut occurs in the desired location. Thus, one design option is to provide an increased thickness of the struts between the bearing spider and the pinched point. The pinched point can be arranged to have an axial thickness that is sufficient to withstand operational loads and provide the desired strength for the structure. In other words, the strut of the embodiment is generally thicker in an axial direction than the known struts used in current devices, apart from at one location where the strut has a similar thickness to known devices. This location is the pinched point, located at the point where the strut and inlet flange are co-located.

We have found that using this arrangement has significant benefits in reducing the movement of the bearing spider when a clamping force is applied to the inlet flange. For instance, our tests have shown that the central bearing spider hub of an embodiment (as shown in FIG. 4), becomes displaced by 5 μm when a 10 Nm clamping force is applied to the inlet flange by claw clamps—this is a reduction of 20 μm from the device shown in FIG. 2, as described above. When using a rotatable flange collar applying a torque force of 10 Nm the bearing spider hub deflected by 45 μm, compared to 200 μm on known systems. As a result, the potentially detrimental displacement of bearing spider caused by the application of a clamping force can be greatly reduced by utilizing the embodiments.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A turbo-molecular vacuum pump comprising: a body having an inlet flange disposed at a high vacuum side for connecting the turbo-molecular vacuum pump with a chamber to be evacuated, and an outlet port disposed at a low vacuum side for exhausting pumped gases from the turbo-molecular vacuum pump; disposed within the body there is a stator and a rotor arranged to move relative to the stator such that, during use, gas molecules are urged from the inlet flange towards the outlet port, the rotor is coupled to a motor by a drive shaft for driving the rotor in a rotary motion;

and bearings for supporting the drive shaft and the rotor in relation to the body, wherein a first bearing is coupled to the rotor and disposed on supporting mount at the high vacuum side of the rotor, radial struts extend from the supporting mount and form an integral part of the body;

characterized in that the radial struts comprise a hinge portion that can flex to allow relative movement of the inlet flange with respect to the supporting mount.

2. The turbo-molecular vacuum pump according to claim 1, wherein the first bearing is a passive magnetic bearing.

3. The turbo-molecular vacuum pump according to claim 1, wherein the radial struts form an integral part of the inlet flange.

4. The turbo-molecular vacuum pump according to claim 1, wherein the hinge portion comprises a notch in the radial strut.

5. The turbo-molecular vacuum pump according to claim 4, wherein an axial depth of the radial strut at the notch is sufficient to prevent axial movement of the supporting mount relative to the body during normal operation of the turbo-molecular vacuum pump.

6. The turbo-molecular vacuum pump according to claim 4, wherein an axial depth of the radial strut at the notch is sufficient to allow the inlet flange to distort when a clamping force is applied without causing the supporting mount to move relative to the body.

7. The turbo-molecular vacuum pump according to claim 4, wherein an axial depth of the notch is between 80% and 10% of an maximum axial depth of the radial strut, or wherein the axial depth of the notch is between 50% and 20% of the maximum axial depth of the radial strut, or wherein the axial depth of the notch is 33% of the maximum axial depth of the radial strut.

8. The turbo-molecular vacuum pump according to claim 4, wherein the notch is formed in the radial strut at a position where the axial strut meets the body.

9. A body for a turbo-molecular vacuum pump, comprising: an inlet flange disposed at a high vacuum side of the body for connecting the body with a chamber to be evacuated, and an outlet port disposed at a low vacuum side for exhausting pumped gases from the body; a cavity arranged to accommodate within the body a pumping stator and a rotor arranged such that, during use, gas molecules are urged from the inlet flange towards the outlet port, a motor and a drive shaft for driving the rotor in a rotary motion; and, at the high vacuum side, a supporting mount arranged to locate a portion of a first bearing that cooperates with another portion of the first bearing for supporting the drive shaft and the rotor in relation to the body, wherein, radial struts extend from the supporting mount and form an integral part of the body;

characterized in that the radial struts comprise a hinge portion that can flex to avow relative movement of the inlet flange with respect to the supporting mount.

10. The body according to claim 9, wherein the first bearing is a passive magnetic bearing.

11. The body according to claim 9, wherein the radial struts form an integral part of the inlet flange.

12. The body according to claim 9, wherein the hinge portion comprises a notch in the radial strut.

13. The body according to claim 12, wherein an axial depth of the radial strut at the notch is sufficient to prevent axial movement of the supporting mount relative to the body during normal operation of the turbo-molecular vacuum pump.

14. The body according to claim 12, wherein an axial depth of the radial strut at the notch is sufficient to allow the inlet flange to distort when a clamping force is applied without causing the supporting mount to move relative to the body.

15. The body according to claim 12, wherein an axial depth of the notch is between 80% and 10% of an maximum axial depth of the radial strut, or wherein the axial depth of the notch is between 50% and 20% of the maximum axial depth of the radial strut, wherein the axial depth of the notch is 33% of the maximum axial depth of the radial strut.

16. The body according to claim 12, wherein the notch is formed in the radial strut at a position where the radial strut meets the body.

* * * * *